US005799940A

United States Patent [19]

Tripp

[11] Patent Number: 5,799,940

[45] Date of Patent: Sep. 1, 1998

[54] METHOD AND APPARATUS FOR AUTOMATIC RANDOM SELECTION IDENTIFICATION

[76] Inventor: Warren W. Tripp, 2070 Driscoll Dr., Reno, Nev. 89509

[21] Appl. No.: 720,441

[22] Filed: Sep. 30, 1996

Related U.S. Application Data

[63] Continuation-in-part of Ser. No. 489,606, Jun. 12, 1995, Pat. No. 5,590,879.

[51] Int. Cl.[6] ..... A63F 3/06

[52] U.S. Cl. ..... 273/144 R; 273/144 B

[58] Field of Search ..... 273/144 R, 144 A, 273/144 B

[56] References Cited

U.S. PATENT DOCUMENTS

| | | | |
|---|---|---|---|
| 3,300,217 | 1/1967 | Franklin | 273/144 A |
| 3,468,542 | 9/1969 | Ernst | 273/144 R |
| 4,877,246 | 10/1989 | Kropkowski | 273/144 R |
| 4,961,578 | 10/1990 | Chateau | 273/144 R |
| 5,121,920 | 6/1992 | Laezzo et al. | 273/144 B |
| 5,590,879 | 1/1997 | Tripp | 273/144 R |

*Primary Examiner*—William H. Grieb
*Attorney, Agent, or Firm*—Herbert C. Schulze

[57] ABSTRACT

A method and apparatus for random determination and use of a multiplicity of bits of information from a larger quantity of bits of information including the placing of individualized information on a number of semi-conductors, mixing the semiconductors in an air chamber, selecting one semi-conductor at a time, placing the semi-conductors as selected on individualized locations on a timing wheel, confirming the selection and placement of the semi-conductors; detecting the information carried by each semi-conductor selected; and using the information so selected.

3 Claims, 6 Drawing Sheets

FIG.2B
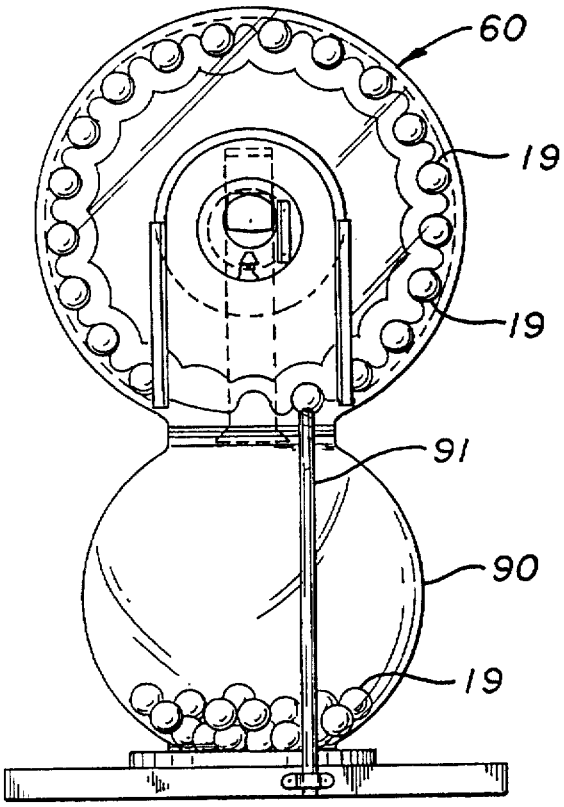
FIG.2D
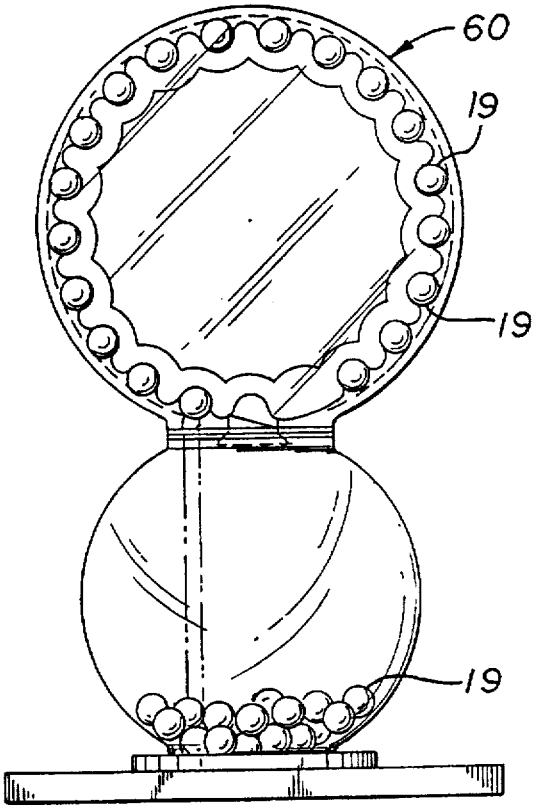
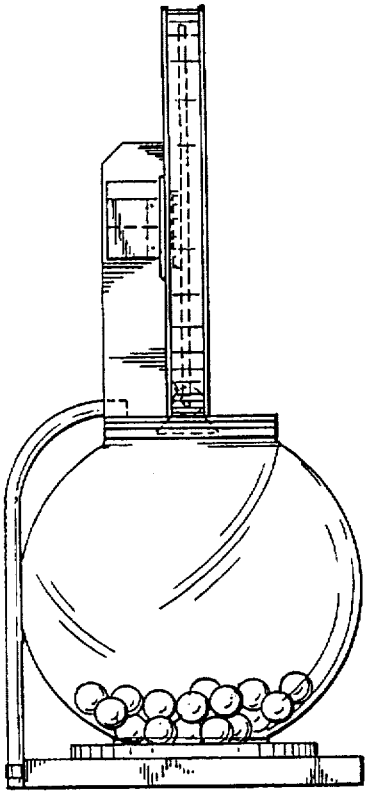
FIG.2C
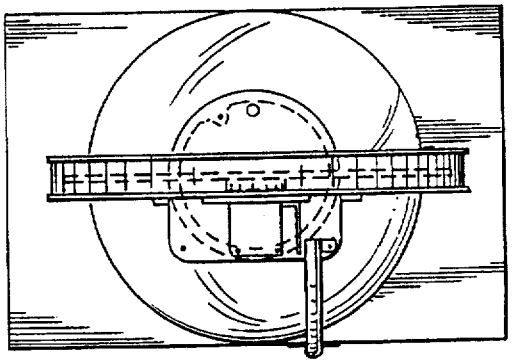
FIG.2A

METHOD AND APPARATUS FOR AUTOMATIC RANDOM SELECTION IDENTIFICATION

CROSS REFERENCE TO RELATED PATENT APPLICATIONS

This patent application is related to and is a continuation in part of my application ser. No. 08/489,606 filed Jun. 12, 1995, now Pat. No. 5,590,879.

BACKGROUND OF THE INVENTION

I. Field of the Invention

This invention is in the general field of random selection of numbers, or other items of information;

The invention is more particularly in the field of random selection through a mixing and selection of elements in a chamber;

The invention is even more particularly directed to a new and unique method and apparatus for selecting, and displaying or using each item of information as selected;

The invention is most particularly directed to a method and apparatus for identifying balls,semiconductors or the like, mixed in an air chamber, individually selected, identified through an electronic identifier, and individually displayed or otherwise used after selection.

II. Description of the Prior Art

In lotteries, keno games, and the like, it is known to mix balls (much like table tennis balls) carrying numbers, or the like, in an air chamber, with gusts of air keeping the balls in a constantly changing arrangement with relation to each other. The balls are then individually selected, by various types of selection arrangements such as tubes receiving one ball at a time, suction devices to pick individual balls, and the like. After selection, the balls are identified by the operator and the results are posted. In some cases attempts have been made to read the balls by a bar code or some other system. To date none of these have been thoroughly satisfactory.

The present invention is unique in utilizing a timing wheel with sockets or other locations for receiving balls, semiconductors, or the like, and a video viewer to view the balls as detected, with means to automatically, or manually, display the results on a display board or otherwise use the information selected.

While the foregoing unique features of this invention were previously described in my co-pending application Ser. No. 08/489,606 filed Jun. 12, 1995, the invention has now been further distinguished and enhanced by now incorporating individual identifiable magnetic, optical, or semiconductor chips or otherwise electronically, magnetically, or optically readable identifiers within or upon the balls or the like used in the operation the automatic random selection identification system.

I know of no prior art utilizing the afore described new system.

SUMMARY OF THE INVENTION

There are many games, lotteries, and other situations in which a certain quantity of numbers or other items are selected from a larger quantity for determination of prizes, statistical work, and other purposes. A common method of selecting such items is to mix the items in a tumbling air chamber, with periodic selection of individual items by having them drop into a tube, or utilizing some other method of selecting the individual items.

Generally, such selection devices are less than fully effective in that the balls are not necessarily picked truly at random, and the results are not necessarily accurately, nor automatically, displayed. Additionally, though it is unlikely, the results could be tampered with by someone adding a number of balls with a certain number identifying the ball, in which case the random selection would be interfered with by the more likely possibility of that certain number appearing than should be in the normal order of selection.

I have now conceived and developed a unique and greatly improved method and apparatus for such random selection and display, in which I have made it virtually impossible for a result other than a strictly random selection to occur by the use of magnetically, optically, or electronically detectable indicia within, or upon, or integral with the ball, or the like, itself.

I accomplish all of this by a timing wheel located adjacent an air tumbling chamber, wherein the wheel has a number of pockets, or sockets, or positions, on its periphery such that it stops until it receives one ball or other item in a socket or other position and then advances to the next position to receive the next ball or item, and so on until the desired number of balls or items has been collected.

Concurrent with the collection of the balls,or the like, a ball or item detector confirms, through a central processing unit, that the ball is in position on the wheel. At the same time, a video camera may view the ball and sends a picture to a vision system computer which is coordinated with the data from the central processing unit.

The results (the selected balls, items, or the like ) are then sequentially displayed on a display board (known to those skilled in the art). Alternately, the results may be manually displayed by an operator at a console which displays on a display board.

It is an object of this invention to provide a reliable random selection and display method and apparatus;

It is a further object of this invention to provide such a method and apparatus wherein there is no possibility of any deviation from true random selection;

It is a further object of this invention to provide such a method and apparatus where the results may be displayed visually, accurately and automatically, or used in some other manner.

It is a further object of this invention to provide such a system as has been described wherein magnetic, optical, semiconductor, or the like, identification means is associated with each item subject to the random selection.

The foregoing and other objects and advantage s of this invention will become apparent to those skill ed in the art up on reading the description of a preferred embodiment which follows in conjunction with a review of the appended drawings.

BRIEF DESCRIPTION OF THE DRAWINGS

FIGS. 2A–2D are a series of schematic elevations of portions of an apparatus suitable to practice the method of this invention;

DESCRIPTION OF A PREFERRED EMBODIMENT

Figure 1:
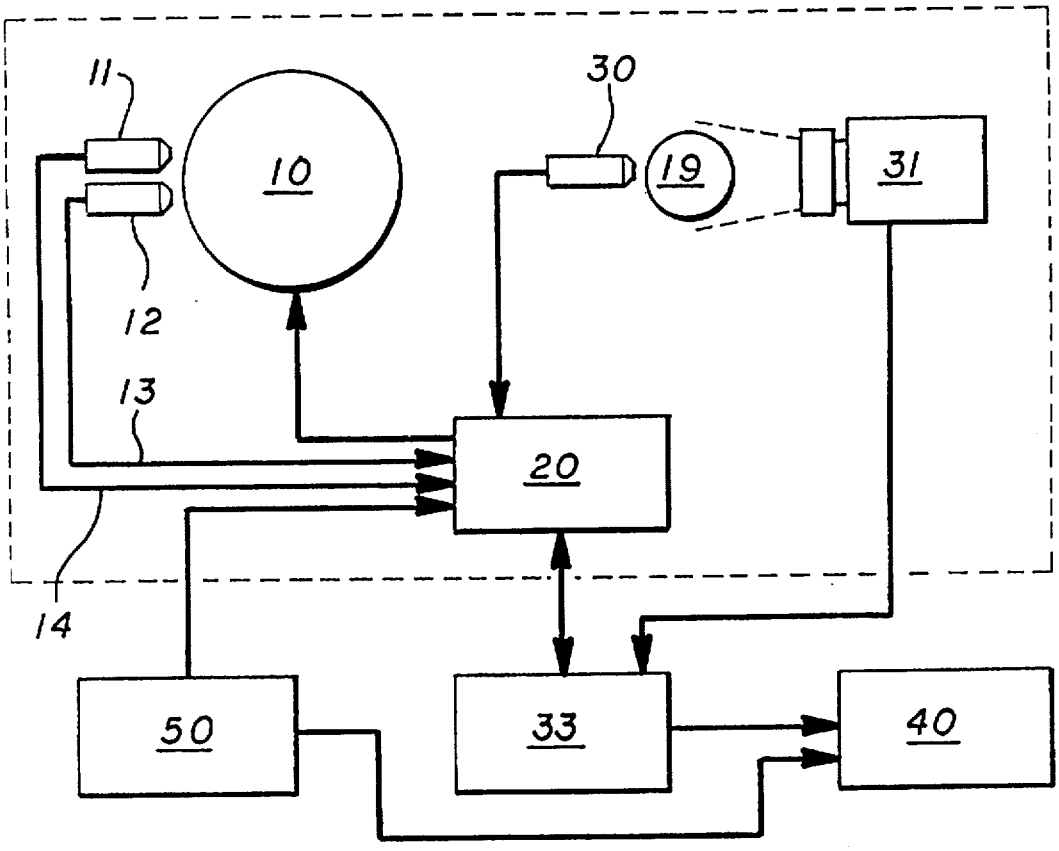
FIG. 1 is a block diagram illustrating the elements of this invention and sequence of operations of the method.

FIG. 1 is a block diagram illustrating the operation, and the invention, in such a manner as will be understood by those skilled in the art. The additional figures (except for FIGS. 7 and 8) are almost superfluous, but are felt to be consistent with a full disclosure.

In FIG. 1 the timing wheel and motor 10 are shown to be controlled by a CPU (central processing unit) 20, known to those skilled in the art, which determines the sequence of operations of the timing wheel, and thus the receipt of the items (balls or the like). The ball "in position" detector 11, and the subsequent "position" detector 12 ensure the accuracy of the placement of the ball, or other item, on the timing wheel. All of this information is processed to the CPU through circuits 13 and 14.

At the same time, ball detector 30 transmits its signal of verification of the ball (or other item) to the CPU.

Video camera, or the like, 31 and CPU 20 transmit their information to a vision system computer, or the like, 33, known to those skilled in the art. The information thus transmitted may be displayed on the results board 40.

Alternatively, the information will be processed through the Tripp Plastics 80 Key Console 50 (known to those skilled in the art) for manual display on the results board 40.

FIGS. 2A–2D have several views of the timing wheel and associated features. 2*a* is a top plan of a device suitable to practice this invention; 2B is a back side elevation thereof; 2C is a right side elevation thereof; not shown is the left side elevation thereof which is a mirror image of 2C; and 2D is a front elevation thereof. As shown, balls will be placed at random within the pockets of the timing wheel until all desired numbers of balls are in place. As each ball is placed, it will be recorded and revealed. Those skilled in the art will understand the working of this upon examining these drawings and the remainder of the drawings as commented upon below.

Figure 5:
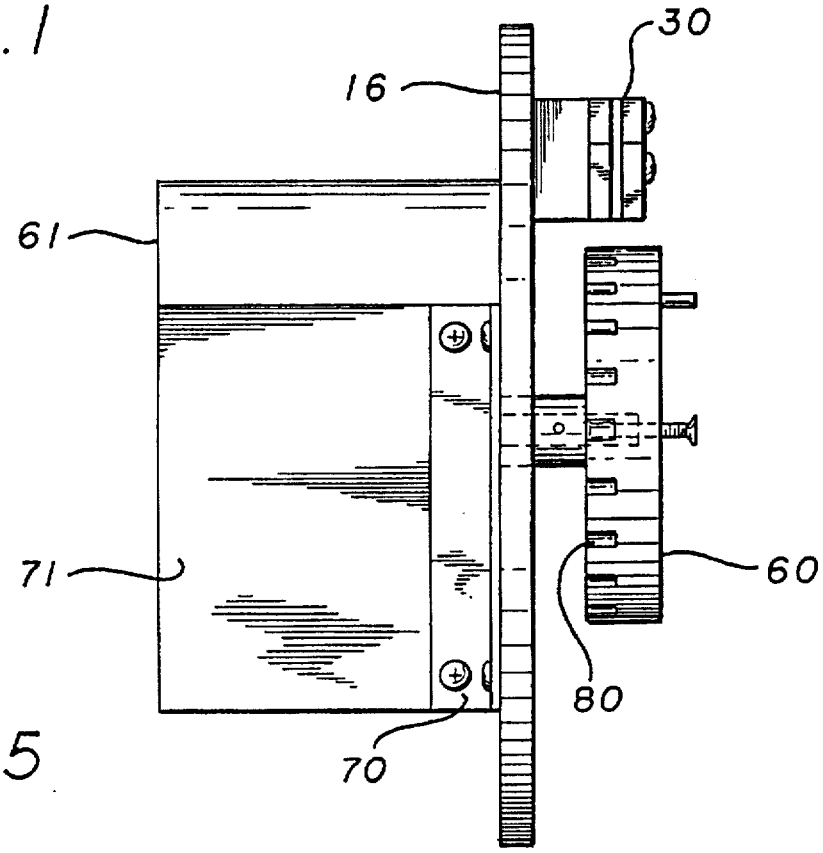
FIG. 5 is a schematic side elevation of elements of a device to practice the method of this invention.
Figure 3:
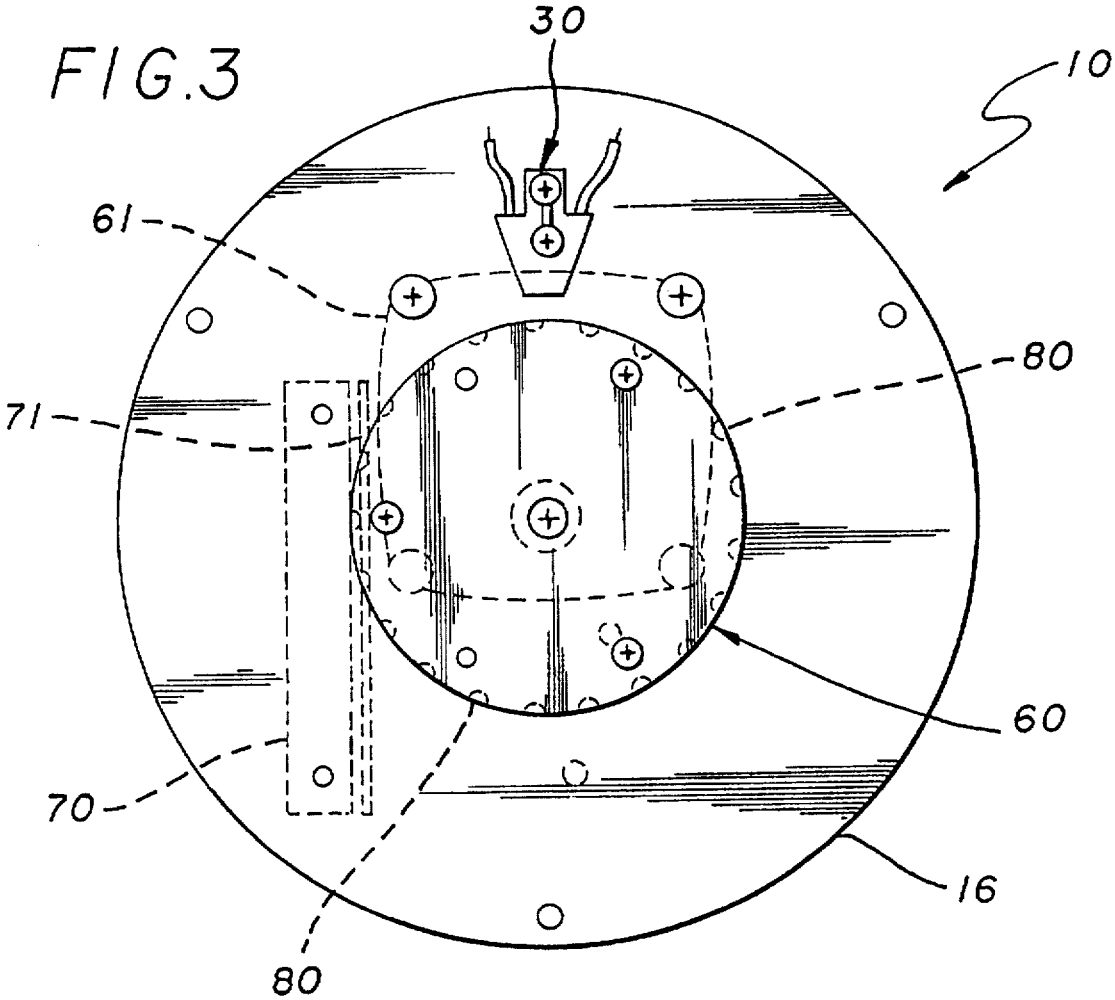
FIG. 3 is a schematic front elevation of elements of a device to practice the method of this invention.
Figure 4:
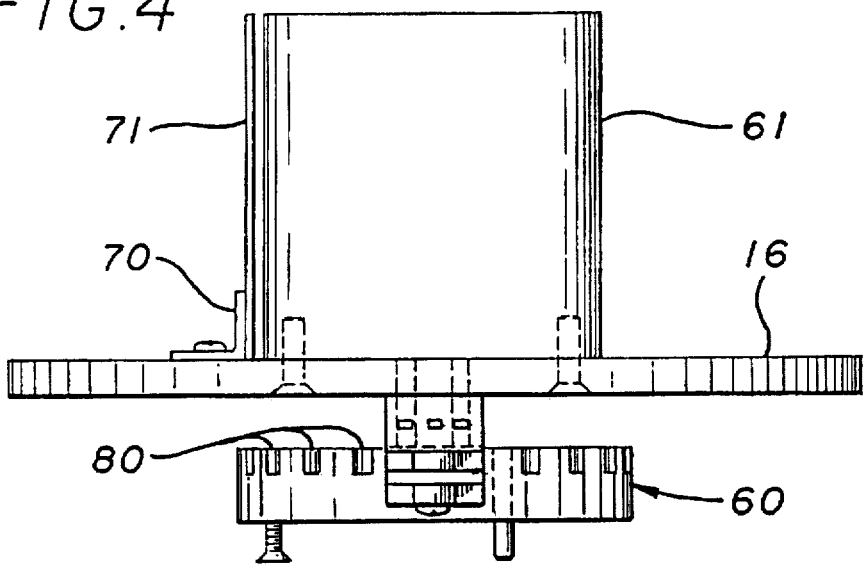
FIG. 4 is a schematic top elevation of the elements of a device to practice the method of this invention.

FIGS. 3, 4 and 5 show the timing wheel 60 mounted upon mounting plate 16, with the reflective sensor 30 in position to read the balls as they are carried by the timing wheel, which is powered by motor 61. Printed circuit board 71 with its microprocessor is mounted on mounting bracket 70. A plurality of ball receiving sockets 80 are shown.

Figure 6:
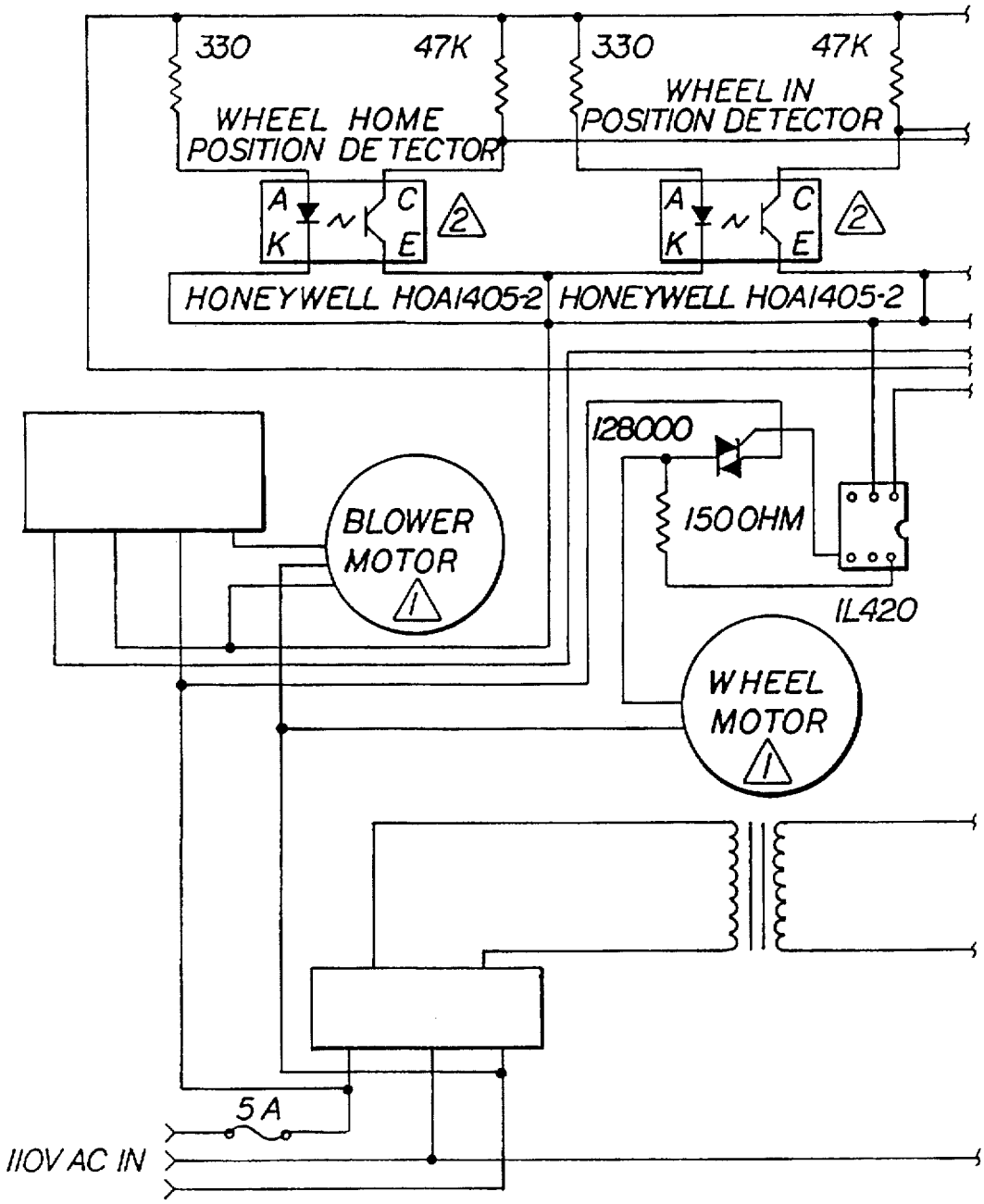
FIG. 6 is a schematic drawing of electrical circuitry.
Figure 6:
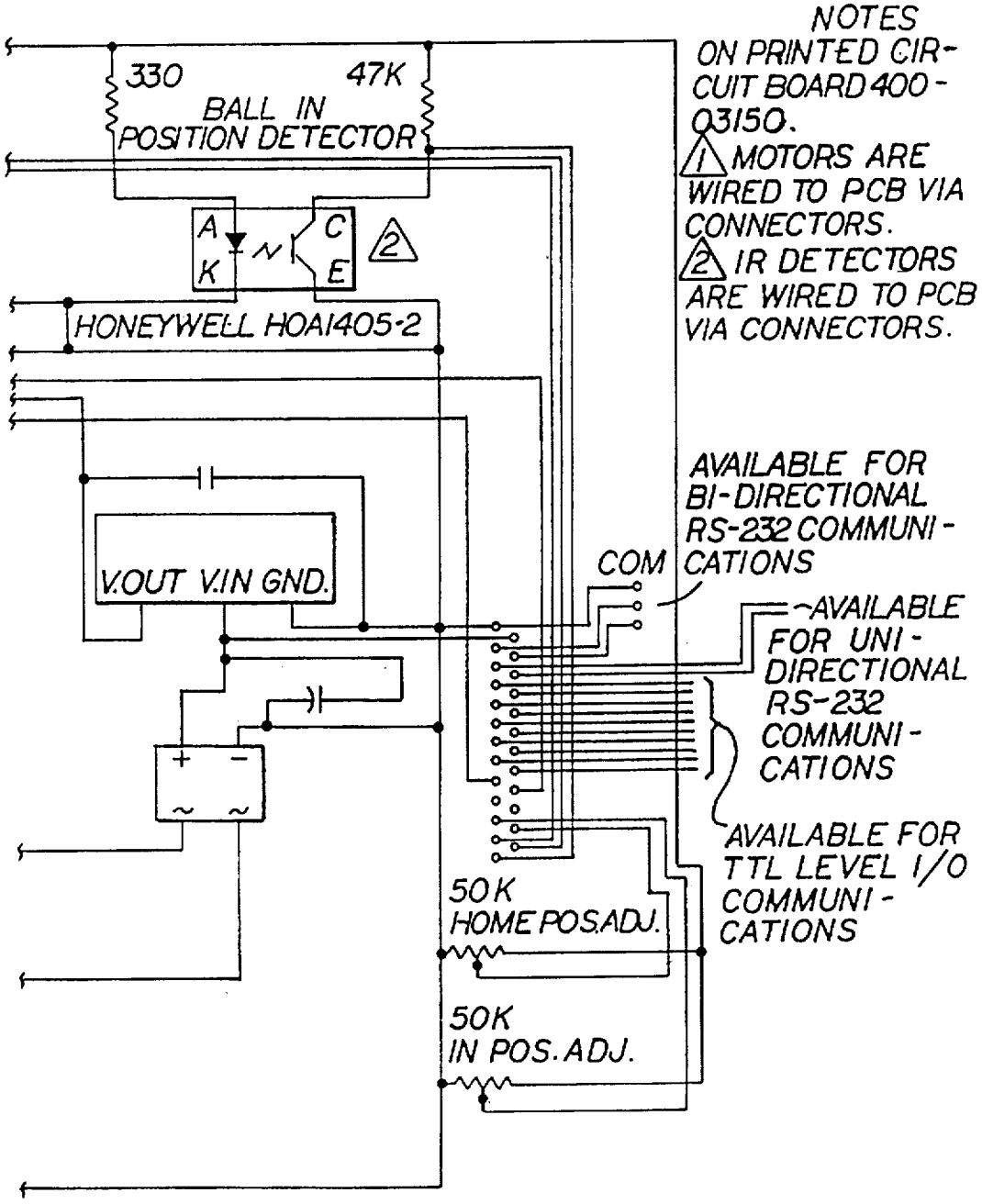

FIG. 6 will be understood by those skilled in the art. FIG. 6 represents the electrical circuitry for the apparatus.

In operation, the balls 19 are agitated by an air blower within chamber 90. The timing wheel will stop until a ball is placed into a socket on the timing wheel by means of the ball selection means 91. When it is confirmed by the sensors that a ball is in the socket the timing wheel will move so as to place the next socket in position. The position of individual balls is detected by the position detectors 11 and 12, which will confirm the accurate positioning of the balls within the sockets on the timing wheel. Individual balls are received into sockets 80 on the timing wheel. The ball detector 30 detects the ball, and at the same time the ball is read by video camera 31. This process will continue until all sockets have been confirmed to be carrying balls.

As each ball is confirmed, the corresponding number of that ball will be displayed on the display board 40 either through a vision system computer 33, know to those skilled in the art, or through a Tripp Plastics 80 key console, known to those skilled in the art. Thus there will be an accurate display of the exact balls selected, as the balls are selected.

In an important alternative embodiment, the balls, or the like, may carry an identifying chip, with or without an external visible marking. In this case, the sensors will include means (known to those skilled in the art) to sense the chip, and thus verify the information (a number, or the like) as to that particular ball, or the like. If the ball, or the like, does not carry a visible marking, the sensor can activate a monitor, or the like, to display the particular indicium carried by the particular ball, or the like, and display it on the display board.

Figure 7:
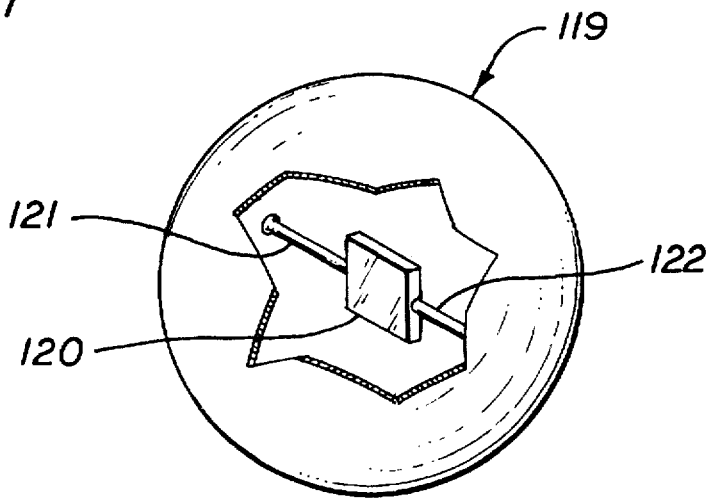
FIG. 7 is a partially broken away perspective of a ball used in random selection carrying a semi-conductor or the like identifier.
Figure 8:
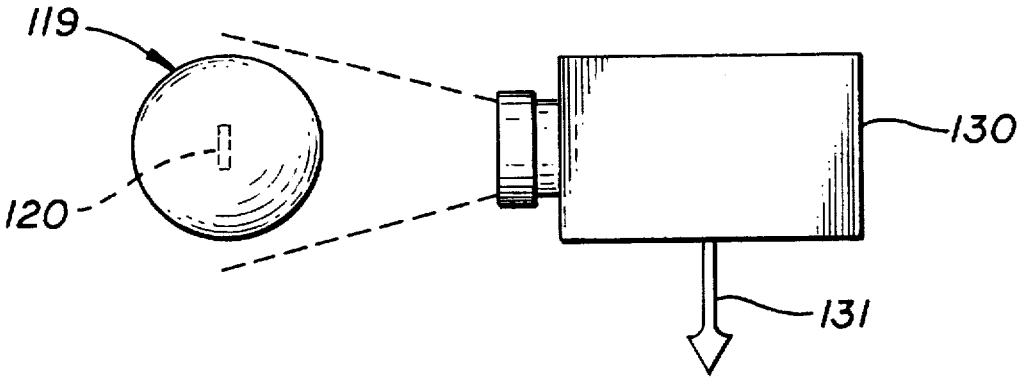
FIG. 8 illustrates the reading and communication of the identifier of FIG. 7.

I have pursued this latter mentioned embodiment still further and have conceived and developed a very useful and unique new method and apparatus to be used in the overall field of automatic random selection. FIGS. 7 and 8 illustrate this important innovation in this art. A ball 119 is shown with a portion broken away revealing a semiconductor (silicone chip or the like) 120 supported at the exact center of the ball by support arms 121 and 122 which are fastened by adhesive or the like at their ends respectively to the chip and to the interior surface of the ball. It must be understood that the chip or the like could, also be totally imbedded within the thickness of the ball material and could be so weighted as to not change the balance of the ball. Even though the chip might cause the ball to be off balance it will not materially affect the random selection since if this is used all balls will be similarly affected. In lieu of the chip, or even in addition to the chip, the ball can carry optical identifying means (like a bar code) or magnetic identifying means (like a credit card) oral identifying means (like a sound emitter). Such identifying means may be imprinted on, or otherwise associated with the ball. The most preferred method of this latest unique system is, of course, the chip, which is not detected by optical or magnetic or oral means, thus assuring the confidentiality of each selection until the selection has been recorded and verified.

When the ball carrying the chip, or the like is selected, it will then be detected and read by a conventional electronic, magnetic or optical reading device 130 as is known to those skilled in the art. This reading will take place in a like manner to that shown in FIGS. 1 through 6 and described above. The chip or the like 120 will be detected and interpreted by the detection device 130. The results of each selection will then be displayed, recorded, announced, or the like by transmission at 131 to whatever ultimate use is desired.

Throughout the foregoing, and in the following claims and abstract, I have referred to "semiconductor", "ball", "item", "chip" "identifier" "information" and the like. It is my intention that "semiconductor" and "chip" include encoding such as megnetic or optical or other electronic code and at the same time be understood to have its own unique position as understood by those skilled in the art. The words "ball" and "item" include most any type physical object. "Identifier" and "information" include an identifying characheristic or message.

While the embodiments of this invention shown and described are fully capable of achieving the objects and advantages desired, it is to be understood that such embodiments are shown for purposes of illustration only and not for purposes of limitation.

I claim:

1. The method of selecting and displaying at random a certain unique identifier carried by each of a number of items by means of a unique semiconductor carried by each of the items from a plurality of identifier carrying items comprising: associating a unique semiconductor identifier on each of a plurality of items; mixing the items and holding the items in suspension in a chamber by blowing air within the chamber; selecting items, one at a time, by an item selector means; placing each item, as selected, in a socket within a moving wheel carrying a plurality of positions; detecting the accuracy of placement of each item within the appropriate position by detection sensors; detecting the identifier of each item as selected by a semiconductor detector; and using identifier so detected.

2. The method of claim 1 wherein the use of the detected identifier is to display information carried by the identifier.

3. Apparatus for selecting at random certain information from a plurality of individually unique information carrying semi-conductors including: a plurality of individual unique semi-conductors; a chamber for mixing the semi-conductors; air blower means associated with said chamber; a semi-conductor selection wheel cooperative with said chamber; means to intermittently move and stop said semi-conductor selection wheel; means to deposit one semi-conductor on said wheel at each stop position; sensor means to detect the information carried by each semi-conductor as each semi-conductor is deposited on said wheel; and means to utilize the information from each semiconductor as detected.

* * * * *